United States Patent [19]

Moser

[11] 4,170,958

[45] Oct. 16, 1979

[54] DEVICE FOR APPLYING DESIGNS

[75] Inventor: Manfred Moser, Krefeld-Fischeln, Fed. Rep. of Germany

[73] Assignee: Eduard Küsters, Krefeld, Fed. Rep. of Germany

[21] Appl. No.: 860,182

[22] Filed: Dec. 13, 1977

[51] Int. Cl.[2] ..... B05C 5/00

[52] U.S. Cl. ..... 118/325; 68/205 R; 118/DIG. 4

[58] Field of Search ..... 118/324, 325, DIG. 4, 118/63; 68/205 R; 427/288

[56] References Cited

U.S. PATENT DOCUMENTS 3,570,275 3/1971 Weber et al. ..... 68/205 R 3,964,860 6/1976 Leifeld ..... 68/205 R X

*Primary Examiner*—John P. McIntosh

*Attorney, Agent, or Firm*—Kenyon & Kenyon

[57] ABSTRACT

In a device for applying designs to advancing webs, particularly textile and similar webs, in which the design liquid is present, prior to application to the web, in the form of a film extending over the web in the width direction an air nozzle in the form of a tube extending across the web close to the film, the tube supported for rotation and for movement back and forth across the web, the tube having a plurality air outlet openings distributed over its surface, and supplied compressed air feed line is used to irregularize the film.

6 Claims, 4 Drawing Figures

DEVICE FOR APPLYING DESIGNS

BACKGROUND OF THE INVENTION

This invention relates to design applying devices for advancing webs, particularly textile and similar webs, in general and more particularly to an improved device of this nature.

Design applying devices in which the design liquid is present, prior to application to the web, in the form of a film extending in the direction of the width of the web, and a movable air nozzle is directed toward the film to irregularize the latter are known.

For example, such an arrangement is described in German Offenlegungsschrift No. 23 61 517. There, an inclined run-off plate over which the design liquid flows down and from the lower edge of which it drops onto the web passing underneath is provided. An air nozzle is directed against the film running down on the run-off plate.

In order to obtain an expressive design with such an arrangement, a multiplicity of air nozzles, all of which would have to be moved separately would be necessary. The cost required therefor would be considerable.

SUMMARY OF THE INVENTION

It is an object of the present invention to realize a design applying device of the type mentioned at the outset in such a manner that an expressive design can be applied to the web in simple fashion.

According to the present invention, this is accomplished with an air nozzle in the form of a tube which is arranged across the web. The tube is rotatable and oscillates across the web, and has air outlet openings distributed over its surface. The tube is connected to a compressed air feed line.

Such a tube is a single element, which requires only one support and one drive. However, it contributes to the formation of the design in three ways, namely, by its rotary motion, its reciprocating motion and the distribution of the air outlet openings over its surface. In this manner, a multiple attack of the air escaping from the air outlet openings on the film and a correspondingly expressive design pattern can be obtained.

In one embodiment comprising a rotating cylinder, which is immersed in a design application liquid contained in a trough above the web and which is arranged above the web, the cylinder picking up design liquid from the trough on its surface, and a stripper which is set at an angle to the web which strips design liquid off the cylinder with its upper longitudinal edge whereafter design liquid flows down onto the web from lower lengthwise edge, the tube is arranged above the stripper.

In an embodiment with a device arranged above the web for producing a shroud of liquid which drops down on the web and extends across the web, on the other hand, the tube is arranged at the height of the shroud.

The distance of the tube above the stripper or in front of the shroud is adjusted in dependence on the available air pressure and the desired design pattern effect.

To avoid unnecessary consumption of compressed air, a covering device for closing off the air outlet openings of the tube, which do not face the film, is advantageous.

The covering device, in turn, may be a slotted tube which surrounds the tube or is arranged inside the tube, where the slot leaves free a segment-shaped area of the tube extending over the length of the tube, from which the air can issue toward the film.

DETAILED DESCRIPTION OF THE INVENTION

Figure 1:
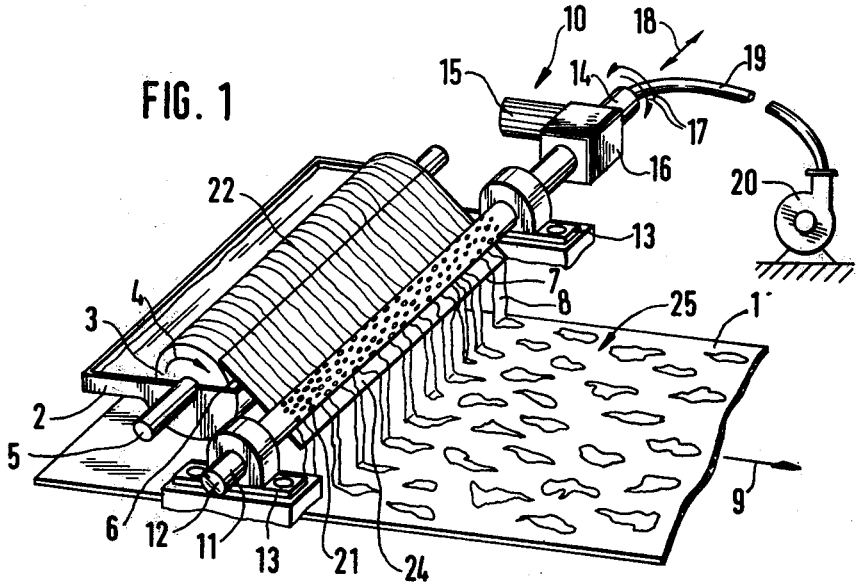
FIG. 1 is a perspective view of a device for dying rug webs with design patterns.

The device 10 in FIG. 1 is a device for dying a rug web 1 advancing horizontally in the direction of the arrow 9 with a design pattern. A trough 2 with dying liquid is arranged across the rug web 1. The lower part of a cylinder 3 is immersed in the dying liquid and picks up dying liquid on its surface when it rotates in the direction of the arrow 4 around the shaft 5 which is arranged perpendicular to the lengthwise direction of the web of material. The dying liquid is taken off the cylinder surface by a stripper 6 which is arranged on the descending side of the circumference of the cylinder 3 and is directed downward at an angle toward the rug web 1. The liquid flows over the surface of the stripper 6 in a film 22, which is initially uniform over the width of the web but is then irregularized in a manner yet to be described and finally drops from the lower edge 7 of the stripper 6 in an irregularized shroud 8 onto the rug web 1.

The dying liquid on the stripper 6 is irregularized by the tube 11, which is closed off at one end 12 and is supported on both sides of the stripper 6 in pillow blocks 13. The other end 14 of the tube 11 is engaged by a drive 16, which is acted upon by a motor 15 and can impart to the tube 11 a rotary motion in the direction of the arrow 17 as well as an oscillating motion across the web 1 in the direction of the arrow 18. The end 14 of the tube 11 is connected to a pump 20, which blows air into the interior of the tube 11 via a flexible tube connection.

Air outlet openings 21 are distributed uniformly or in a pattern over the surface of the tube 11. From these air outlet openings 21, the compressed air emerges in jets 23 against the film 22 of the dying liquid, which had been uniform up to then, and makes it irregular.

Figure 2:
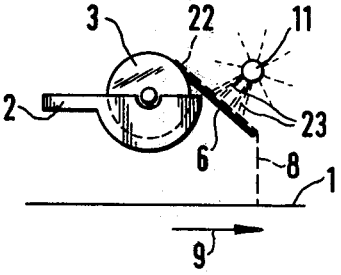
FIGS. 2 and 3 are schematic side views of two different embodiments of the present invention.
Figure 4:
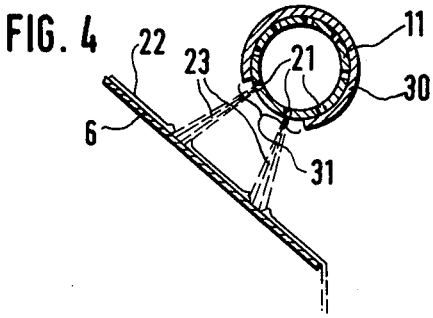
FIG. 4 is a partial cross section through a particular embodiment of a tube with the air outlet openings shown on an enlarged scale.

In the embodiment of FIG. 1, which is shown in schematic side view in FIGS. 2 and 4, the air jets 23 impinge on the film of dying liquid 22 while the latter is on the stripper 6. As indicated in FIG. 4, the dying liquid is thereby displaced in places and piled up in bead-like fashion in the adjoining areas, so that the originally uniform film 22 becomes an irregular layer of liquid 24 (FIG. 1), which slides down over the lower part of the stripper 6 and arrives at the web 1, from the lower edge, in the form of a quite irregular shroud 8 causing an accordingly irregular pattern 25 to result on the web 1.

The design pattern can be influenced in the desired manner by suitable choice of the motions in the direction of the arrows 17 and 18, the distance of the tube 11 above the stripper 6, the air pressure in the tube 11 and the arrangement and size of the air outlet openings 21.

Figure 3:
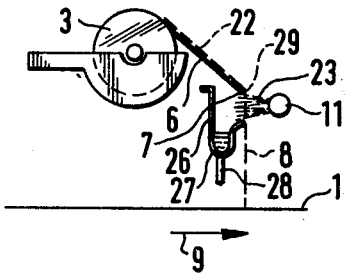

While in the embodiment of FIGS. 1, 2 and 4, the tube 11 is arranged above the stripper 6, FIG. 3 shows an embodiment, in which the tube 11 is arranged at the height of the shroud of liquid 29 dropping from the lower edge 7 of the stripper 6. At the instant when it separates from the lower edge 7, the falling shroud 29 is, therefore, still uniform. It is irregularized by the air jets 23 only in the course of dropping and then likewise arrives as an irregular shroud 8 at the rug web 1. A collecting wall 26 extending over the width of web 1 with a lower channel 27 may be provided for collecting the liquid portions blown away by the air jets 23. The collected liquid can be discharged from channel 27 via a line 28 and can be returned to the trough 4.

In FIG. 4, a covering device in the form of a slotted tube 30 is shown, surrounding the tube 11 with the air outlet openings 21. Tube 30 leaves only a segment 31 from which the air jets 23 can emerge, free on the side facing the liquid film 22. The remaining area of the circumference the outer tube 30 covers up the air outlet openings 21, so that the emergence of air is limited to the segment 31 and no excessive air losses occur. The tube 30 can at the same time be used for supporting the tube 11.

The mode of operation with the pattern applying device can be varied in many ways. Several of the design applying devices shown, with the same or different design liquids, can be arranged in tandem. Prior to the application of the design and, in the case of several design application devices in tandem, any desired preliminary or intermediate treatment can be performed between the individual design application, for instance, impregnating the material with a wetting agent or thickener, or background coloring which is applied with a Foulard or a screen printing mechanism or the like. The design liquid can be applied wet-on-wet or also on a dry or dried web.

What is claimed is:

1. In a device for applying designs to advancing webs, particularly textile and similar webs in which the design liquid is present, prior to application to the web, in the form of a film extending over the web in the width direction, and having a movable air nozzle, which is directed toward the film for irregularizing the film the improvement comprising said air nozzle being in the form of a tube extending across the web close to the film, said tube supported for rotation and for movement back and forth across the web, said tube having a plurality air outlet openings distributed over its surface and directed toward said film, a compressed air feed line coupled to said tube; and means for rotating said tube and moving said tube back and forth.

2. The improvement according to claim 1 wherein said device comprises a rotating cylinder which extends above the web and is immersed in a design pattern liquid contained in a trough arranged crosswise above the web, and which picks up design liquid from the trough on its surface; and a stripper which is inclined at an angle to the web for stripping the liquid from the cylinder with its upper longitudinal edge and for permitting the design liquid to flow down onto the web from its lower longitudinal edge and wherein said tube is arranged above the stripper.

3. The improvement according to claim 2 and further a covering device for closing off the air outlet openings of the tube other than those facing the film.

4. The improvement according to claim 1 wherein said device is a device arranged above the web for generating a falling shroud of liquid which extends across the web and drops down onto the web and wherein said tube is arranged opposite said falling shroud.

5. The improvement according to claim 4 and further a covering device for closing off the air outlet openings of the tube other than those facing the film.

6. The improvement according to claim 1 and further a covering device for closing off the air outlet openings of the tube other than those facing the film.

* * * * *

UNITED STATES PATENT AND TRADEMARK OFFICE

CERTIFICATE OF CORRECTION

PATENT NO. : 4,170,958

DATED : October 16, 1979

INVENTOR(S) : Manfred Moser

It is certified that error appears in the above—identified patent and that said Letters Patent is hereby corrected as shown below:

On the Title Page, after "[22] Filed Dec. 13, 1977"

add: --[30] Foreign Application Priority Data Sept. 29, 1977

[DE] Fed. Rep. of Germany ....2743742--.

Signed and Sealed this

*Twenty-ninth* Day of *November 1983*

[SEAL]

*Attest:*

GERALD J. MOSSINGHOFF

*Attesting Officer*

*Commissioner of Patents and Trademarks*